US006085768A

United States Patent [19]

Arlotta

[11] Patent Number: 6,085,768

[45] Date of Patent: Jul. 11, 2000

[54] PORTABLE SHADE DEVICE

[76] Inventor: Angelo Arlotta, 35 Gilchrist Avenue, Ottawa, Ontario, Canada, K1Y 0M7

[21] Appl. No.: 09/136,061

[22] Filed: Aug. 19, 1998

[51] Int. Cl.[7] ..... E04H 15/28

[52] U.S. Cl. ..... 135/98; 135/124; 135/20.1; 403/217

[58] Field of Search ..... 135/96, 97, 98, 135/124, 136, 156, 160, 115, 117, 120.3, 20.1, 16, 155; 403/171, 215, 217, 218

[56] References Cited

U.S. PATENT DOCUMENTS

| | | | |
|---|---|---|---|
| 307,522 | 11/1884 | Butlin | 135/16 |
| 3,794,279 | 2/1974 | Kramer | 248/44 |
| 5,390,685 | 2/1995 | McCoy . | |
| 5,396,915 | 3/1995 | Bomar | 135/16 |
| 5,711,331 | 1/1998 | Harris . | |
| 5,871,026 | 2/1999 | Lin | 135/98 |

FOREIGN PATENT DOCUMENTS

| | | | |
|---|---|---|---|
| 1200173 | of 0000 | Canada . | |
| 2237193 | 5/1991 | United Kingdom | 135/20.1 |
| WO 96/03560 | 2/1996 | WIPO . | |

*Primary Examiner*—Carl D. Friedman
*Assistant Examiner*—Winnie Yip
*Attorney, Agent, or Firm*—Marks & Clerk

[57] ABSTRACT

A portable shade device having dome shaped supporting structure of elongate, tubular members. An umbrella having UV blocking properties is clamped to the supporting structure with a clamping device that allows the umbrella to be positioned so as to provide shade to occupants of the device at all times of the day. A side wall member may also be attached to protect against reflected rays from water or sand. Additionally, a floor may form part of the device.

14 Claims, 5 Drawing Sheets

PORTABLE SHADE DEVICE

FIELD OF THE INVENTION

This invention relates to a device for providing protection against the sun's rays and more particularly to a portable shade device having an umbrella-like sun shade which can be positioned independently on a portable support structure.

BACKGROUND

In light of changing environmental conditions, and in particular the reduction in the ultraviolet absorbing ozone layer, exposure to the sun's rays is becoming more of a concern to the good health of individuals. Studies indicate that prolonged exposure to the sun whether directly or through reflected rays can increase the likelihood of contacting harmful skin conditions including melanoma. Lotions and creams having ultraviolet blocking properties are available but to be completely effective such products must be applied to all exposed skin. This is frequently not done either because individuals forget to apply the substance or fail to provide a complete coverage. At greatest risk are children as they may not want to have the materials applied or may intentionally or inadvertently wash the covering off. The effects of over exposure to the sun are unlikely to appear for several years at which time it may be too late.

It is, of course, natural for people to want to enjoy the fresh air and breezes of the outdoors whether in their backyard, the neighborhood park or at the beach. There is, accordingly, a requirement for a shade device which will provide protection against UV rays and which is convenient to use.

PRIOR ART

Different types of shade devices such as awnings, tents, canopies, etc. are currently available. Awnings are usually permanently or semi-permanently attached to buildings and as such are limited to providing shade in a fixed location. Tents are typically quite portable but as they are intended to provide privacy and protection against the elements they do not allow free flow of air and therefore tend to become very hot in the summer sun. Canopies can be used to provide protection from the sun directly over head but are less effective against the sun's rays arriving from an angle to the surface. Canopies also do not protect against reflected rays which are a common source of harmful UV radiation in locations next to reflecting surfaces such as water, sand beaches, etc.

U.S. Pat. No. 5,390,685 which issued Feb. 21, 1995 to Jens McCoy discloses a collapsible shelter which employs an umbrella-type device attached to a pole having a pointed end which may be driven into the ground for support. The umbrella-type device is clamped to the pole by means of an arrangement which allows some horizontal and vertical adjustment. As this umbrella-type device is intended to be secured to a single pole it is limited in size and therefore will not accommodate more than one or two people. Further, it is designed to protect against the rain and therefore makes no provision for protecting against reflected UV rays.

SUMMARY OF THE INVENTION

The present invention provides a portable shelter that can be easily erected on various types of surfaces and terrain, that protects against both direct and reflected UV rays and that has an umbrella-like structure that can be conveniently and independently positioned in relation to the sun's position in the sky. The shelter can be manufactured in a range of sizes so as to accommodate one or two people or a group of people.

Therefore in accordance with the present invention there is provided a shade device comprising: a free standing, dome-shaped support structure; an umbrella-like member; and a clamping device on the umbrella-like member for releasable engagement with the support structure.

In one embodiment of the invention a side wall for protection against reflected rays can be attached to the support structure.

It is also anticipated that the device will optionally include a floor.

BRIEF DESCRIPTION OF THE DRAWINGS

The invention will now be described in greater detail with reference to the attached drawings wherein.

DETAILED DESCRIPTION OF THE INVENTION

Figure 1:
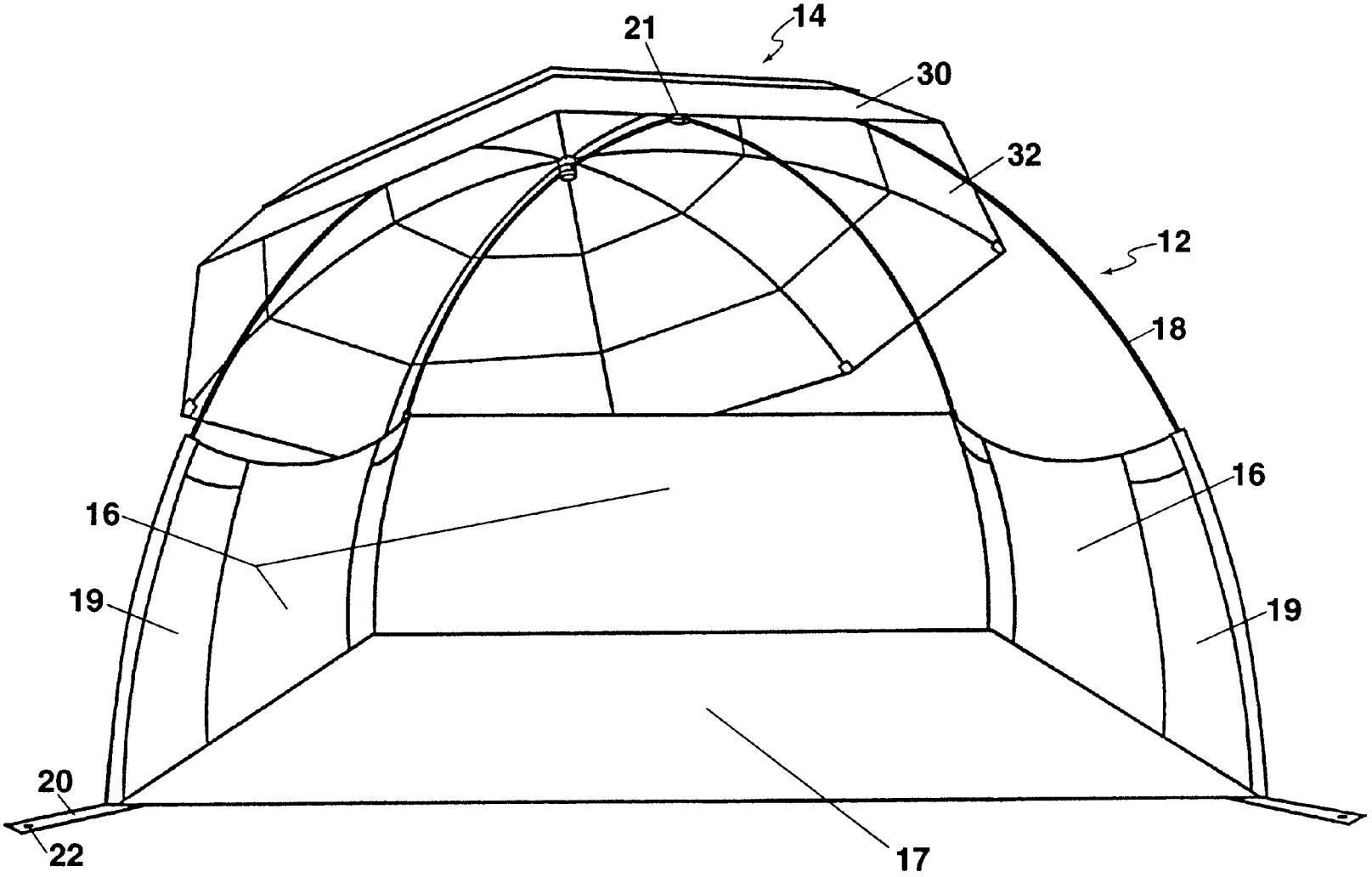
FIG. 1 is a perspective view of the portable shade device according to the present invention.

As shown in FIG. 1 the portable shade device of the present invention has a dome shaped supporting structure 12, an umbrella-like member 14 secured to the supporting structure 12 and optionally a side wall 16 and/or a floor 17. An alternative to a full floor is a partial floor such as straps or the like (not shown) connecting the elements of the supporting structure. The supporting structure 12, in a preferred embodiment, is comprised of elongate elements 18 which are secured to the ground or other appropriate surface using feet 20. Pegs or post are driven through holes 22 to secure the elements 18 to the ground. If the shade device is being erected on other types of surface other securing means will be used. For example nails or screws can be used if the surface is wood or similar materials. If the device is to be set up on concrete, pavement, etc. weights might be suitably placed on the floor. Alternatively, weighting material can be placed in pockets 19 which in one embodiment of the invention are sewn or otherwise formed in the side wall. It is also contemplated that pockets 19 can be used to hold other articles such as magazines, books etc. or other personal effects that might be needed by occupants of the shade device. The pockets will also be useful for storing other parts of the shade device when it is taken down for storage or for relocating. The pegs, poles, etc. could be placed in the pockets and the side wall rolled up in a compact form for ease of carrying.

Figure 6:
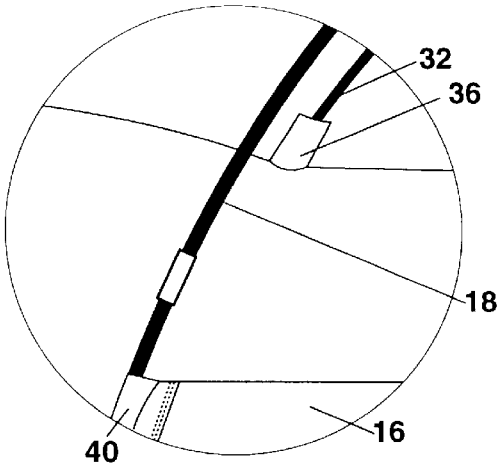
FIG. 6 is an enlarged view of insert 6 of FIG. 4.
Figure 7:
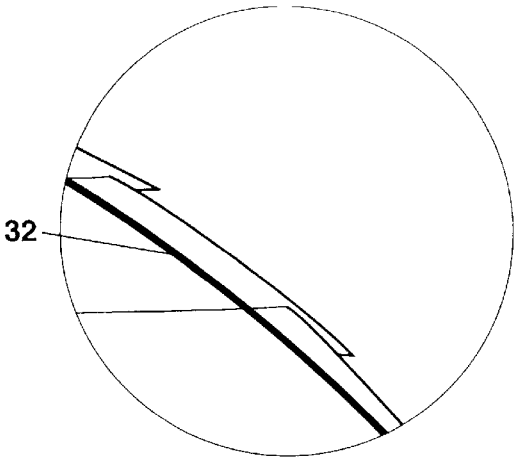
FIG. 7 is an enlarged view of insert 7 of FIG. 4.
Figure 8:
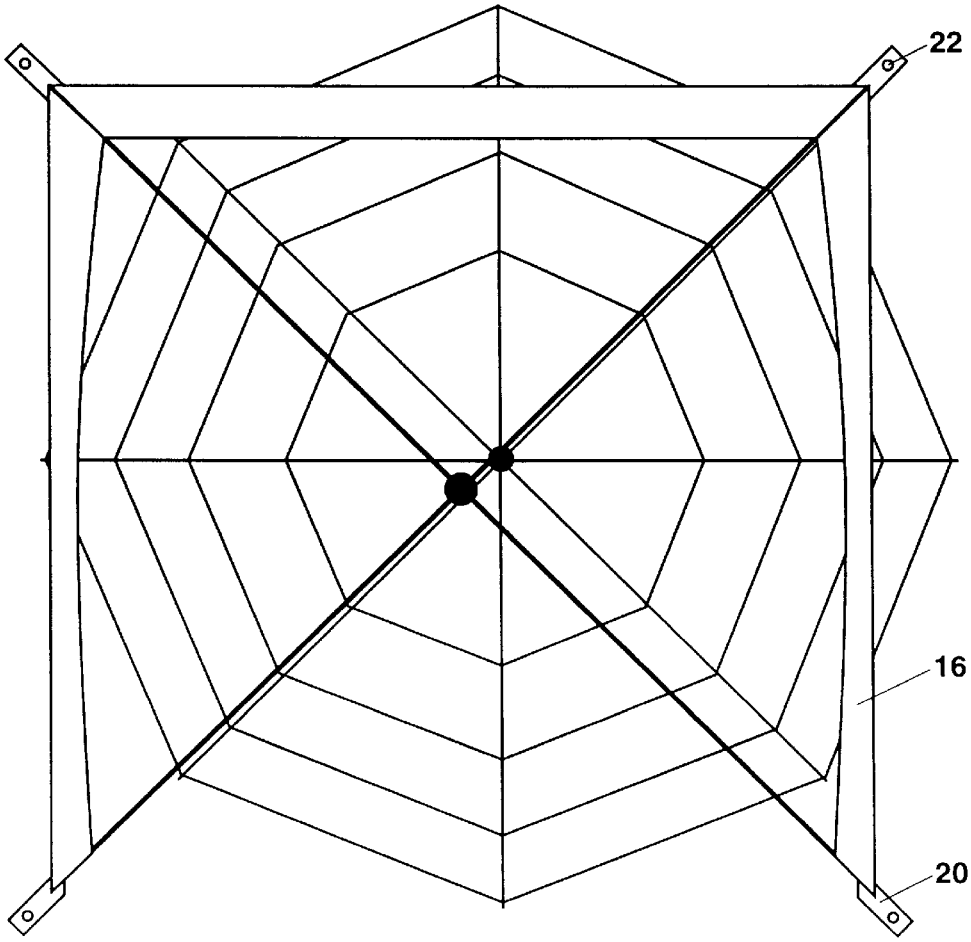
FIG. 8 is a bottom view of the shade device according to the invention.

In one embodiment of the invention elements 18 are tubular and are sufficiently flexible to be bent into the dome shape shown in FIG. 1. Alternatively, elements 18 can be rigid and pre-curved into the desired shape. At least two elements 18 are used with opposite ends secured to the ground or other surface with central portions thereof meeting or crossing over at the intersection. In one particular embodiment the elements 18 are joined at the apex by means of a connector 21 as seen in FIG. 1. Flexible tubular elements as commonly used for dome tents are contemplated by the invention. It is further contemplated that the elements 18 will be made up of shorter members joined by suitable couplings 23 as shown in FIG. 6. Alternatively, the elements may have a spring loaded wire or cord stretched through the center in order to allow the elements to be released and folded into shorter lengths for easy storage. In this configuration the central cord will pass through apertures in the connector 21. These types of tubular elements are known for use as tent poles with the aforementioned dome tents.

Umbrella-like member 14 consists of a fabric type covering 30 stretched over flexible members 32. Covering 30 is of a treated material that is known to provide protection against ultraviolet radiation. Suitable materials include treated forms of nylon, polyester, polyurethane and commercially available material such as solution-dyed acrylic fabric available from Glen Raven Mills, Inc. under the Trademark SUNBRELLA. It is also anticipated that covering 30 may, for certain applications, be water resistant or water proof for use in protecting against rain.

Figure 2:
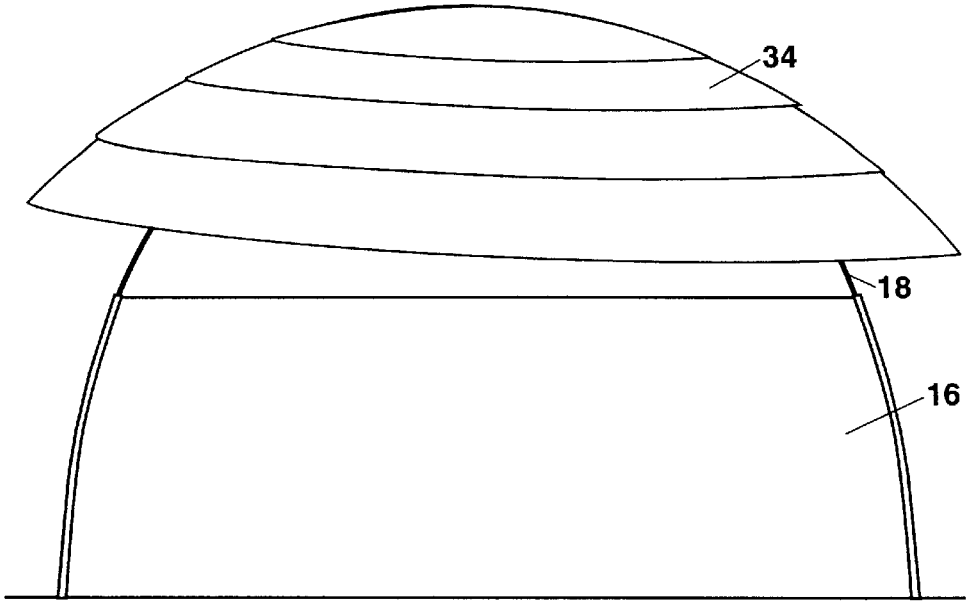
FIG. 2 is a rear view of the device of FIG. 1.
Figure 3:
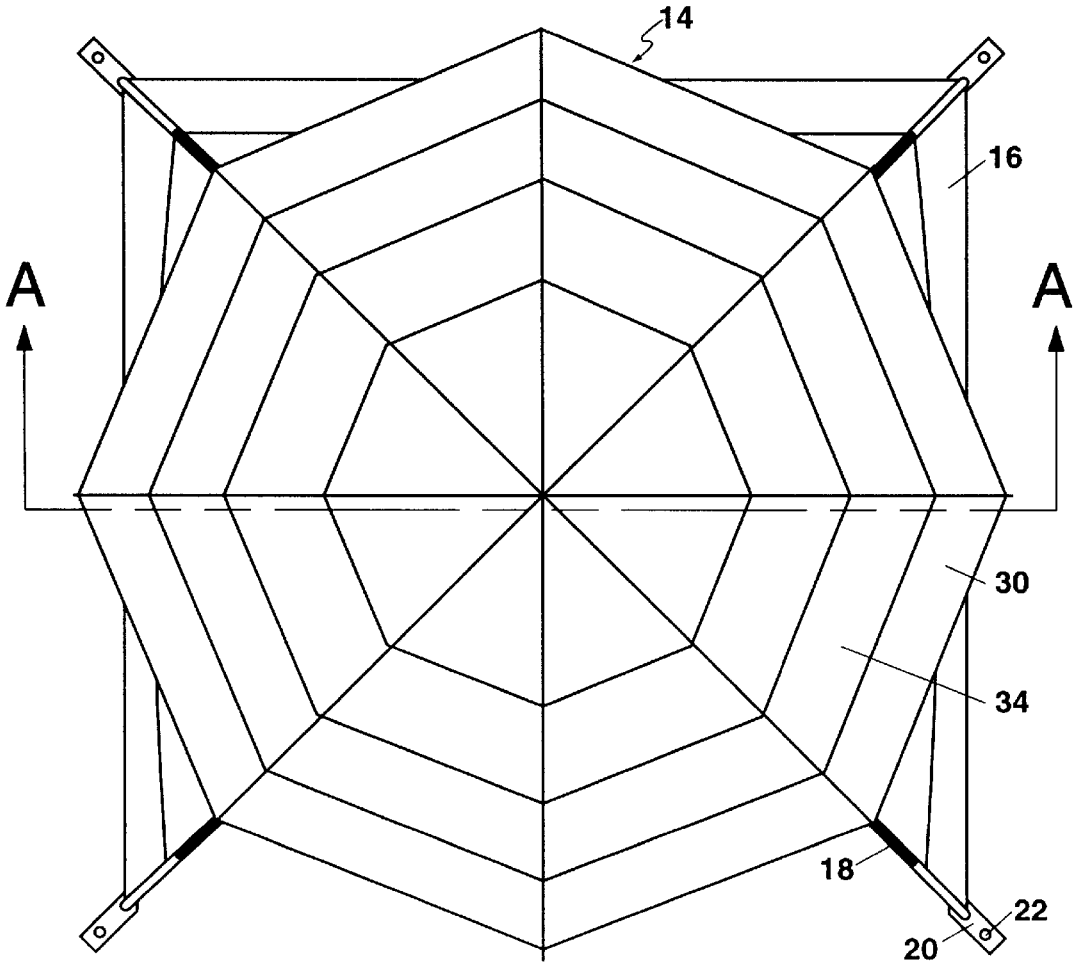
FIG. 3 is a top view of the potable shade device of FIG. 1.
Figure 4:
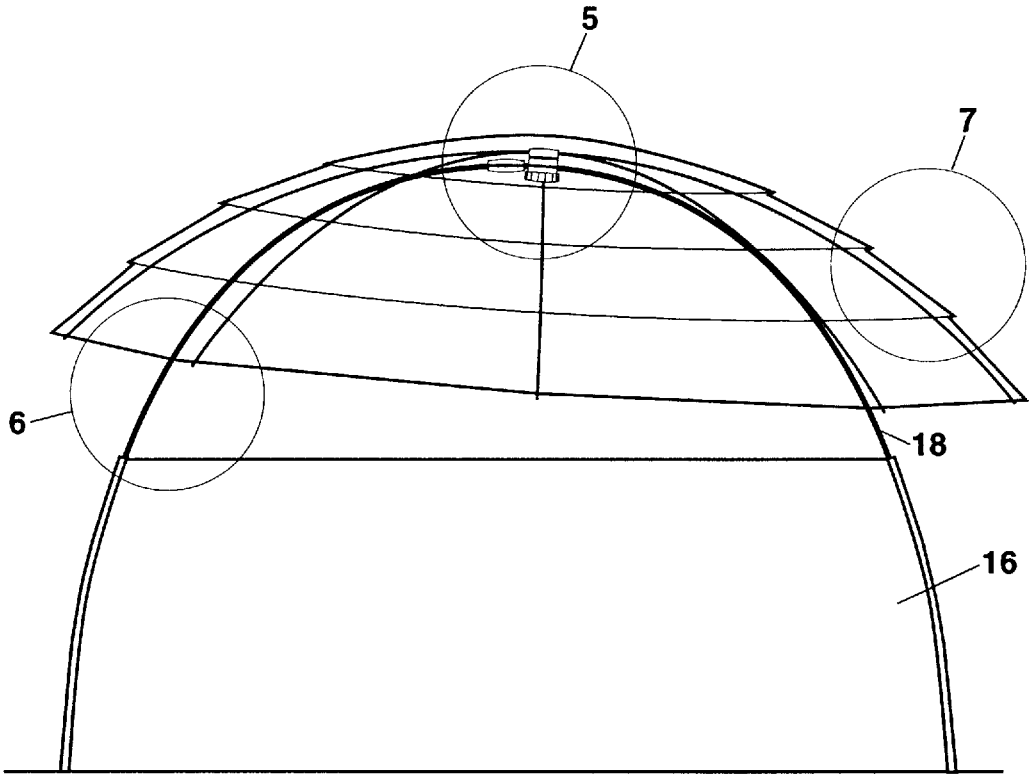
FIG. 4 is a cross sectional view taken along line A—A of FIG. 3.

As shown in FIGS. 2 and 3 covering 30 can be made up of overlapping layers 34 or a single sheet of material cut to the desired shape. One advantage of using the overlapping layered configuration is that the wind is able to flow between the layers making the structure less susceptible to wind effects. Additionally, heated air which normally would collect within the dome is allowed to escape through the layers. For ease of carrying and storage covering 30 may be folded for packing.

As best seen in FIG. 6 the distal ends of flexible members 32 fit into pockets 36 suitably formed on the underside of covering 30. The opposite ends of flexible members 32 are retained by a clamping device which will be described in greater detail later.

The side wall 16 shown in FIG. 1 is intended to prevent reflected UV rays from reaching occupants of the shade device. As is known the sun's rays are reflected off surfaces such as water and sand and can cause sever burns to individuals sitting on a beach or otherwise near water. According to one embodiment of the invention the side wall 16 is attached to the support structure 12 by forming a sleeve 40 in the side wall material and passing the tubular member 18 through the sleeve. This is shown, for example, in FIG. 6. Alternatively, It will be apparent that the side wall, also made of material having UV blocking properties, can be configured to cover just one side of the structure or all sides. It is also contemplated by the invention to attach the side walls to the supporting structure by other attachment means such as zippers, straps with buckles and/or dome fasteners or Velcro.

The shade device of the present invention can be constructed so as to accommodate a large group of people, although from a practical aspect it will find particular application for smaller groups of eight or so. It will also be apparent that such a structure could be assembled in a family's back yard to provide a shaded area for children to play. If desired the side walls can be used in such a construction to keep the children within a confined space.

Figure 5:
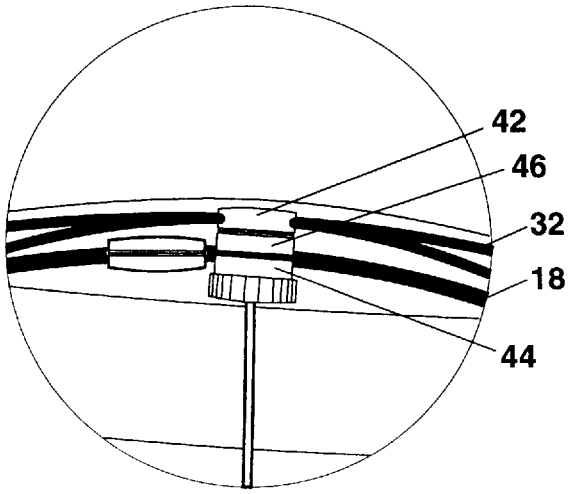
FIG. 5 is an enlarged view of the clamping element of insert 5 of FIG. 4.
Figure 9:
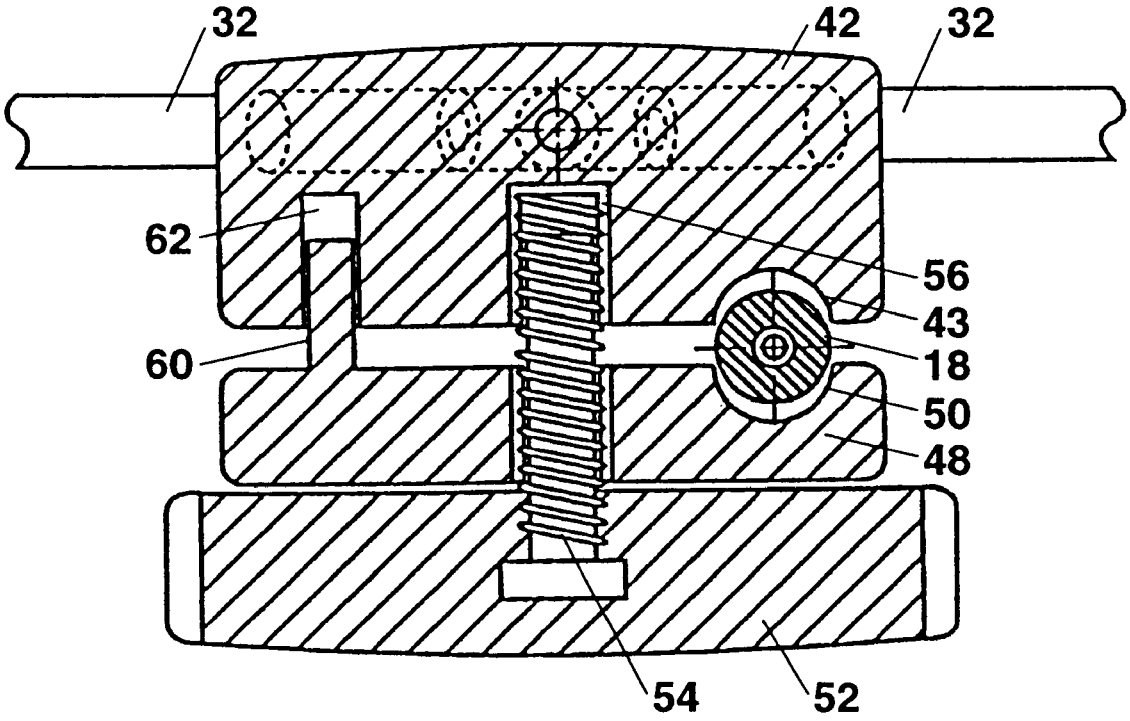
FIG. 9 is a cross sectional view of one embodiment of the clamping element.

The clamping device used to support the umbrella-like member on the supporting structure is best seen in FIGS. 5 and 9. In the embodiment shown in FIG. 5 element 42 has a plurality of axial, spaced apart apertures for receiving ends of the flexible members 32 used to support the umbrella-like covering 30. The flexible members having one end placed into the apertures are of an appropriate length to stretch the covering material when the opposite ends are secured in pockets 36. In a preferred embodiment, as shown in FIG. 9 the flexible members 32 have a spring loaded wire or cable through the center which also passes through the connector element 42. This serves to keep the members 32 attached to the connector although the spring loaded wire allows them to be pulled away from it sufficiently to permit the umbrella-like device to be collapsed and rolled up for storage. In the clamping device of FIG. 5 connector element 42 is connected to clamping elements 44 and 46 by a central treaded rod attached to knob 52.

The clamping element in a preferred embodiment and as shown in FIG. 9 includes the aforementioned connector 42 which is provided with a groove 43 and a second member 48 which is provided with complementary groove 50. Grooves 43 and 50 are of an appropriate size to receive tubular member 18 of support structure 12. A knob 52 having a threaded shaft 54 passes through member 48 and mates with threaded portion 56 in connector 42. As will be apparent, adjustment of knob 52 will cause grooves 43 and 50 to clamp onto tubular member 18 or to be released therefrom. Guide pin 60 on member 48 and complementary mating aperture 62 in connector 42 help to keep the two components 48 and 42 from twisting. In this manner the umbrella-type member can be clamped on the supporting structure in the appropriate position to block the sun's rays. Loosening the clamping members allows the umbrella member to be moved along the arcuate shape of the dome structure and clamped again at a desired new position. Similarly, the umbrella can be pivoted by a limited amount on the tubular member. The clamping member can be removed from one of the members 18 to the orthogonal tubular member if that is more suitable in view of the sun's location relative to the supporting structure.

Although particular embodiments of the invention have been described and illustrated it will be apparent to one skilled in the art that numerous modifications and variations can be implemented without departing from the basic concept. It is to be understood, however, that such modifications and variations will fall within the full scope of the invention as defined by the appended claims.

I claim:

1. A shade device comprising:

a support structure having a plurality of pole members joined together in a dome shape;

an umbrella-like member having a fabric covering stretched over a plurality of flexible ribs; and a clamping device located centrally on said umbrella-like member, said clamping device having: a first portion with means for receiving and securing said ribs; a first slot and a threaded opening on one face of said first portion;

a second portion locatable adjacent said first portion, said second portion having a second slot in a face next to and aligned with said first slot, said first and second slots cooperatively dimensioned to receive one of said pole members; and an opening through said second portion; and threaded attachment means passing through said opening in said second portion for threaded engagement in said threaded opening whereby turning said attachment means in a tightening direction clamps said umbrella-like member on one of said pole members.

2. A shade device as defined in claim 1 wherein said pole members are flexible.

3. A shade device as defined in claim 1 wherein said pole members are pre-curved to provide said dome shape.

4. A shade device as defined in claim 2 wherein each of said pole members is made up of two or more sections.

5. A shade device as defined in claim 1 wherein said fabric covering comprises a material having ultra violet (UV) blocking properties.

6. A shade device as defined in claim 5 wherein said flexible ribs are removably attached to said covering material.

7. A shade device as defined in claim 1 wherein said attachment means on said clamping device permits said umbrella-like member to be fixed in different positions along said supporting structure.

8. A shade device as defined in claim 1 further including a side wall member removably attached to said support structure.

9. A shade device as defined in claim 1 further including a floor member removably secured to a bottom section of said support structure.

10. A shade device as defined in claim 1 said support structure having securing means at a surface engaging level for securing said shade device to said surface.

11. A portable shade device comprising: a free standing supporting structure having at least two elongate, tubular members each having means on opposed ends for placement on a surface whereby central portions of said tubular member extend above said surface in an dome shaped arrangement; an umbrella-like member having a flexible shell of UV blocking material stretched over a plurality of flexible rods; and a clamping device having a first element with means to receive said flexible rods and thereby support said umbrella-like member and a first slot cooperating with a second slot in a second element to receive said tubular member, said first and second elements having threaded means whereby turning said threaded means in a first direction clamps said clamping device to one of said tubular members of said supporting structure and turning said threaded means in a second direction permits said umbrella-like member to be moved along said tubular member and clamped in another selected location on said support structure.

12. A portable shade device as defined in claim 11 further having a flexible sheet member of UV blocking material removably attached to said supporting structure so as to provide at least a partial side wall to said device.

13. A portable shade device as defined in claim 11 having a floor secured to said elongate tubular members at said opposed ends.

14. A portable shade device as defined in claim 11 wherein said supporting structure, said tubular members and said umbrella-like member are collapsible.

* * * * *